US008534949B2

(12) United States Patent
Steffier et al.

(10) Patent No.: US 8,534,949 B2
(45) Date of Patent: Sep. 17, 2013

(54) TOOTHBRUSH WITH REACTIVE COMPOSITION FOR REMINERALIZATION OF TEETH

(75) Inventors: Larry W Steffier, Cherry Hill, NJ (US); George M Lein, Elkton, MD (US)

(73) Assignee: MYCONE Dental Supply, Co., Inc., Cherry Hill, NJ (US)

( * ) Notice: Subject to any disclaimer, the term of this patent is extended or adjusted under 35 U.S.C. 154(b) by 0 days.

(21) Appl. No.: 13/806,448

(22) PCT Filed: Jul. 30, 2010

(86) PCT No.: PCT/US2010/043856

§ 371 (c)(1), (2), (4) Date: Dec. 21, 2012

(87) PCT Pub. No.: WO2012/015422

PCT Pub. Date: Feb. 2, 2012

(65) Prior Publication Data

US 2013/0101965 A1 Apr. 25, 2013

(51) Int. Cl.
*A46B 11/04* (2006.01)

(52) U.S. Cl.
USPC ..... 401/270; 401/47

(58) Field of Classification Search
USPC ..... 401/44, 47, 183–186, 270, 277, 278, 401/279, 282, 284, 286, 288
See application file for complete search history.

(56) References Cited

U.S. PATENT DOCUMENTS 3,070,102 A 12/1962 MacDonald et al.
3,076,218 A 2/1963 Cook et al.
3,302,230 A 2/1967 Poppelmann et al.
5,213,428 A * 5/1993 Salman ..... 401/7
5,348,153 A 9/1994 Cole
5,571,502 A 11/1996 Winston et al.
5,603,922 A 2/1997 Winston et al.
5,678,273 A 10/1997 Porcelli
5,723,107 A 3/1998 Bake-Haskins et al.
5,783,249 A 7/1998 Sanduja et al.

(Continued)

FOREIGN PATENT DOCUMENTS

KR 10-0817454 B1 3/2008
KR 10-0915718 B1 9/2009
WO WO2009-151455 A1 12/2009

OTHER PUBLICATIONS

The International Search Report and the Written Opinion of the International Searching Authority issued on Apr. 26, 2011 by KIPO.

(Continued)

*Primary Examiner* — David Walczak

(74) *Attorney, Agent, or Firm* — Michael B. Fein; Eckert Seamans Cherin & Mellott

(57) ABSTRACT

A toothbrush having brush means and a means to support the brush means; and a one or two part therapeutic tooth treatment composition which becomes activated when wet incorporated on the brush means or within the toothbrush means to support the brush means in a manner such that the composition remains inactive during storage and is only activated when contacted with water or saliva; and a method comprising brushing a tooth with the toothbrush so that the brush means become wet with saliva, optionally wetting the brush means with water immediately prior to brushing a tooth, and the composition becomes activated to form a therapeutic composition to provide remineralization, whitening, and/or fluoridation.

14 Claims, 7 Drawing Sheets

(56) References Cited

U.S. PATENT DOCUMENTS

| | | | | |
|---|---|---|---|---|
| 6,120,754 | A | 9/2000 | Lee et al. | |
| 6,372,198 | B1 | 4/2002 | Abbate | |
| 6,485,708 | B1 | 11/2002 | Winston et al. | |
| 7,182,542 | B2 | 2/2007 | Hohlbein | |
| 7,478,452 | B2 * | 1/2009 | Rosenblood et al. | 15/111 |
| 7,517,541 | B2 * | 4/2009 | Mezine et al. | 424/747 |
| 7,575,387 | B2 | 8/2009 | Atkin | |
| 8,092,110 | B2 * | 1/2012 | Russell et al. | 401/270 |
| 2003/0194678 | A1 | 10/2003 | Viltro et al. | |
| 2004/0136929 | A1 | 7/2004 | Zaidel et al. | |

OTHER PUBLICATIONS

The International Preliminary Report issued on Nov. 30, 2012 by KIPO.

* cited by examiner

TOOTHBRUSH WITH REACTIVE COMPOSITION FOR REMINERALIZATION OF TEETH

BACKGROUND OF THE INVENTION

This invention relates to the field of dentistry, more particularly to articles and methods for treating teeth. More particularly the invention relates to toothbrushes which comprise a composition incorporated in the brush or handle thereof.

In the field of toothbrushes, others have suggested disposable toothbrushes with various types of compositions bonded to or incorporated within brush means thereof. For example, U.S. Pat. No. 5,783,249 to Sanduja, et al., discloses a disposable toothbrush having mint flavored toothpaste composition bonded to the brush means thereof; U.S. Pat. No. 3,076,218 to Cook, et al., discloses toothbrush handles which contain fluoride; U.S. Pat. No. 7,575,387 to Atkin discloses a toothbrush which comprises one or two part-spherical pockets of matching shape of dehydrated toothpaste placed in the depressions so that when the brush is wetted, the pellets or balls turn into a gel, ready for brushing; U.S. Pat. No. 7,182,542 to Hohlbein discloses a disposable toothbrush containing a rupturable container containing a dentifrice connected to the bristle portion of the toothbrush head for dispensing dentifrice to the teeth.

In the field of disposable toothbrushes intended for one time use, it is conventional to use inexpensive handles and brushes as compared to toothbrushes which are designed for long term use. Among such disposable toothbrushes are ones which have bristles and a handle similar in appearance to long term use toothbrushes, and others such as the one disclosed in U.S. Pat. No. 5,678,273 to Porcelli, which is an applicator which is designed to attach to the ball of a user's fingertip which finger functions as an articulated handle for a brush which consists of a dense array of multi-strand filamentary loops that form the bristles of a miniature brush. MacDonald, U.S. Pat. No. 3,070,102 also discloses a disposable toothbrush with bristles supported by a flexible strip which has adhesive for adhering to a user's finger. Cole, U.S. Pat. No. 5,348,153 discloses another disposable finger-mounted toothbrush with brush means mounted on a sheath configured to be unfurled onto a user's fingertip.

In the field of dentistry the use of one and two part compositions to remineralize teeth and one and two part compositions for fluoridating teeth have been suggested by others, for example U.S. Pat. Nos. 5,571,502, 5,603,922, and 6,485,708 to Winston, et al. disclose two part and one part compositions for remineralization of teeth and which do not react to any large extent until introduced into the oral cavity. In the case of one part remineralization compositions, Winston disclosed use in forms of toothpaste, gels, professional gels which are to be applied professionally or are obtained by prescription, mouthwashes, rinses, troches, chewing gum, lozenges and the like. In the case of two part compositions, Winston disclose a first composition maintained separate from a second composition and the two parts are combined outside the oral cavity to form a paste which is then applied to teeth. U.S. Pat. No. 6,372,198 to Abbate and U.S. Pat. No. 6,120,754 to Lee, et al., also disclose two part compositions for remineralization of teeth which are combined, formed into a paste, and applied to the tooth surface where the diffused ions react together to form an insoluble precipitate on the surface or subsurface of the tooth. U.S. Pat. No. 5,723,107 to Blake-Haskins, et al., discloses a dual component dentifrice for fluoridating teeth, and U.S. Pat. Pub. 2004/0136929 of Zaidel, et al., discloses a dual component tooth whitening dentifrice.

Various methods of applying such two part remineralization, whitening, and fluoridating compositions are taught in these patents and publication, each of which is cumbersome, difficult, unwieldy, unduly costly, or is otherwise disadvantageous. For example, Zaidel, et al., discloses a dispensing container such as a double barreled syringe.

It is an object of the present invention to provide a more convenient, more efficient, and less cumbersome method and apparatus for carrying and applying dental remineralization, whitening, or fluoridation compositions to teeth.

SUMMARY OF THE INVENTION

This object, and others which will become apparent from the following description and accompanying drawings, are achieved by the present invention which comprises in one aspect a toothbrush having brush means and a means to support the brush means; and a remineralization, whitening, or fluoridating tooth treatment composition incorporated on the brush means or within the means to support the brush means in a manner such that the composition remains inactive during storage and only becomes active when contacted with water or saliva.

In another aspect the invention comprises a method of therapeutically treating a tooth comprising activating the composition and brushing the tooth with the toothbrush in order to remineralize, whiten, or fluoridate the teeth of the user.

In some embodiments the composition is a two part composition selected from the group consisting of a remineralization composition, a whitening composition, and a fluoridating composition.

Depending on the particular application, in embodiments employing a two part composition, the two parts of the composition can be incorporated in different portions of the brush means, the different portions being either in minimum contact or preferably separated by portions having no composition incorporated therein so that the two parts do not come in contact with each other until the toothbrush is wet with water or saliva and brushing occurs. In other embodiments, one or two parts of the two part composition are placed in compartments in the brush support means such as a handle having channels or compartments therein which can be ruptured and compressed to squeeze out the compositions.

In some embodiments the composition is a stable one part composition comprising two or more salts in a hydrophilic, non-aqueous vehicle.

In certain embodiments the composition is a stable one part remineralization composition comprising at least one water-soluble calcium compound and at least one water-soluble phosphate compound and optionally a water-soluble fluorine compound in a hydrophilic, non-aqueous vehicle comprising glycerin.

The toothbrush can be prepared by dipping the brush means in a one part tooth composition and drying. In other embodiments a one part whitening or fluoridization composition can be applied to a brush means in a similar manner.

The toothbrush can, in some embodiments, include a first strip of a first composition on the brush means and a second strip of a second composition separated from the first strip so that the first and second compositions do not contact each other.

In other embodiments the composition is in the form of dry powder incorporated on or within the brush means so that the toothbrush is storage stable.

The toothbrush can be produced by providing a toothbrush having brush means and a means to support the brush means, incorporating on the brush means or within the toothbrush means to support the brush means a one or two part composition in a manner such that the composition remains inactive during storage and is only activated when contacted with water or saliva.

In some embodiments the tooth brush can be constructed wherein the composition comprises a first part incorporated in a first chamber in the means to support the brush means and a second part incorporated in a second chamber in the means to support the brush means in a manner such that the first part and the second part are released from the means to support the brush means onto the brush means upon mechanical force being applied to the means to support the brush means and, upon contact with each other, the two parts react in the presence of water or saliva.

BRIEF DESCRIPTION OF THE DRAWINGS

Other objects and advantages of the invention will become apparent upon reading the following detailed description and upon reference to the accompanying drawings in which.

DETAILED DESCRIPTION

Figure 1:
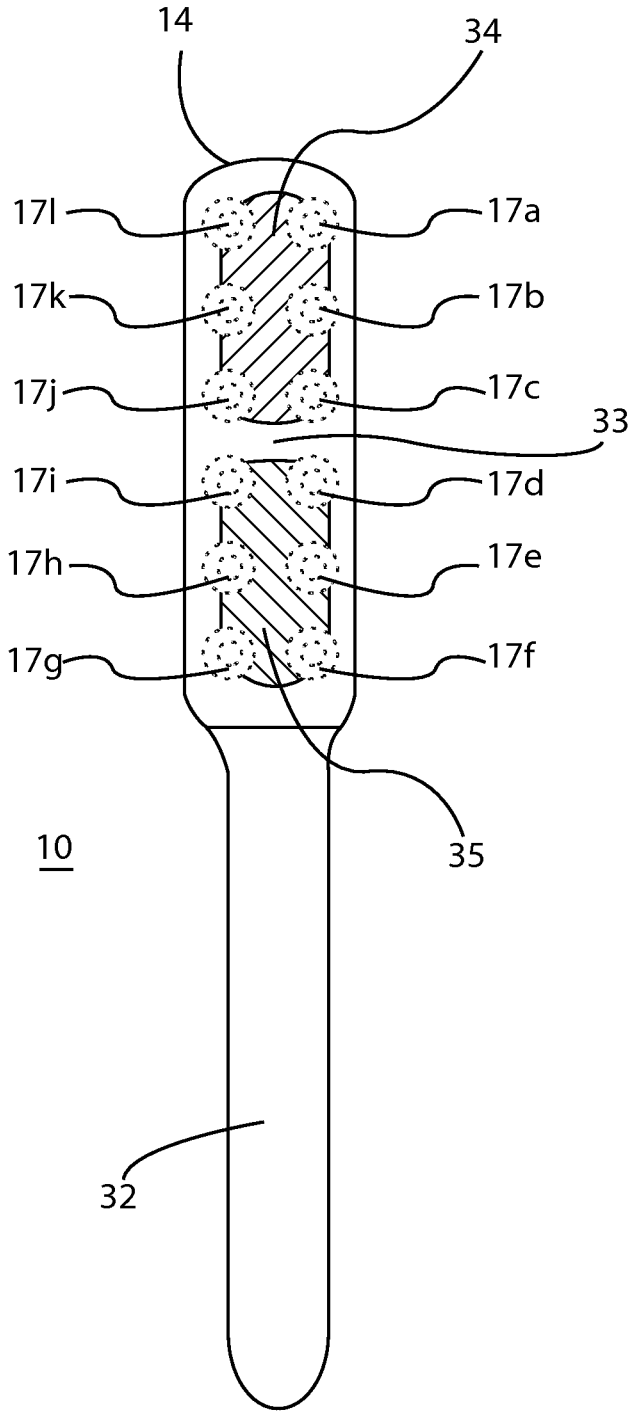
FIG. 1 is a top perspective view of an embodiment wherein the tooth treatment composition is a two part composition and each of the two parts is incorporated in different portions of the brush means.

Referring first to FIG. 1, a top perspective view of an embodiment is shown wherein the tooth treatment composition is a two part composition and each of the two parts is incorporated in different portions of the brush means, the different portions being separated by portions having no composition incorporated therein so that the two parts do not come in contact with each other until the toothbrush is wet with water or saliva and brushing occurs. The toothbrush can be prepared, for example, by spraying, brushing or other means of addition, separate solutions each containing one of the reactive components to the desired areas 34 and 35 of the toothbrush, optionally followed by drying. A toothbrush 10 is illustrated which includes handle 32, twelve sets of bristles 17*a*-17*l*, bristle support 14, and a two part remineralizing composition, the first part 34 deposited between the bristles 17*a*, 17*b*, 17*c*, 17*j*, 17*k* and 17*l* of the forward section and the second part 35 deposited between bristles 17*d*, 17*e*, 17*f*, 17*g*, 17*h*, and 17*i* of the back section, with an area 33 between the first part 34 and the second part 35 of bristle support 14 with no composition deposited or carried.

Figure 2:
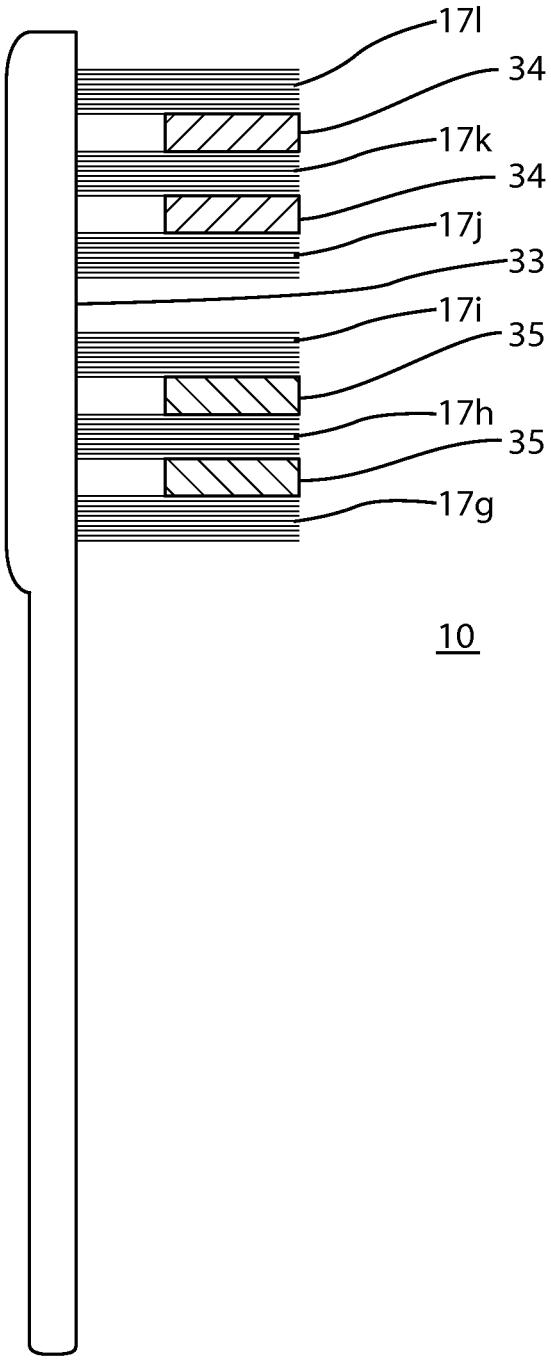
FIG. 2 is a side view of the embodiment of FIG. 1.

FIG. 2 is a side perspective view of the embodiment of FIG. 1 showing the first part 34 of the remineralizing composition between the bristle sets 17*l*, 17*k*, 17*j* in the front section. (Sets 17 *a*, 17*b*, and 17*c* cannot be seen in this view). The second part 35 is shown between bristle sets 17*i*, 17*h*, and 17*g* in this side view.

Figure 3:
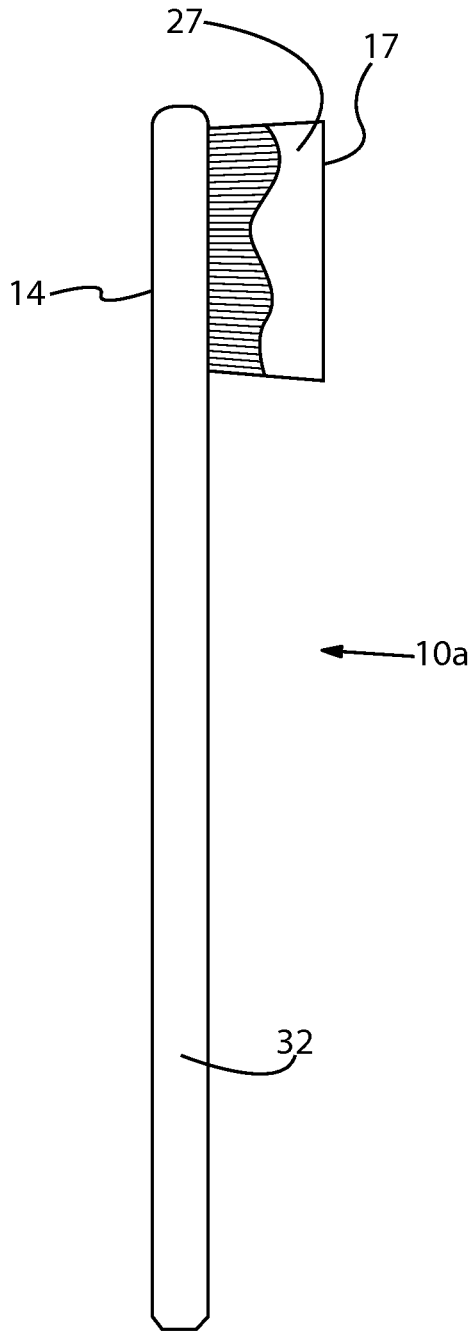
FIG. 3 is a side elevational view of an alternative embodiment of a toothbrush wherein the tooth treatment composition is one component.

FIG. 3 is a side elevational view of an alternative embodiment of a toothbrush 10*a* with bristles 17, one part demineralizing composition 27, support 14, and handle 32.

Figure 4:
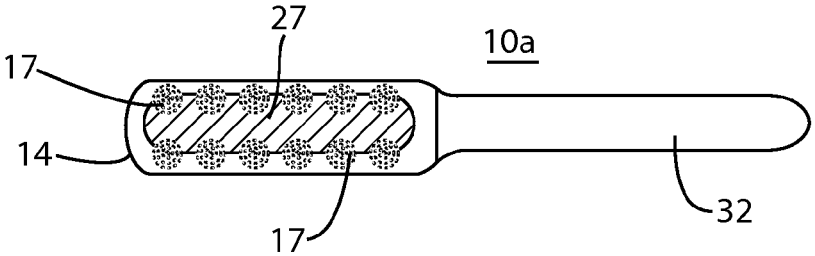
FIG. 4 is a top perspective view of the toothbrush of FIG. 3.

FIG. 4 is a top perspective view of toothbrush 10*a* showing the dry remineralizing composition 27 between bristles 17.

Figure 5:
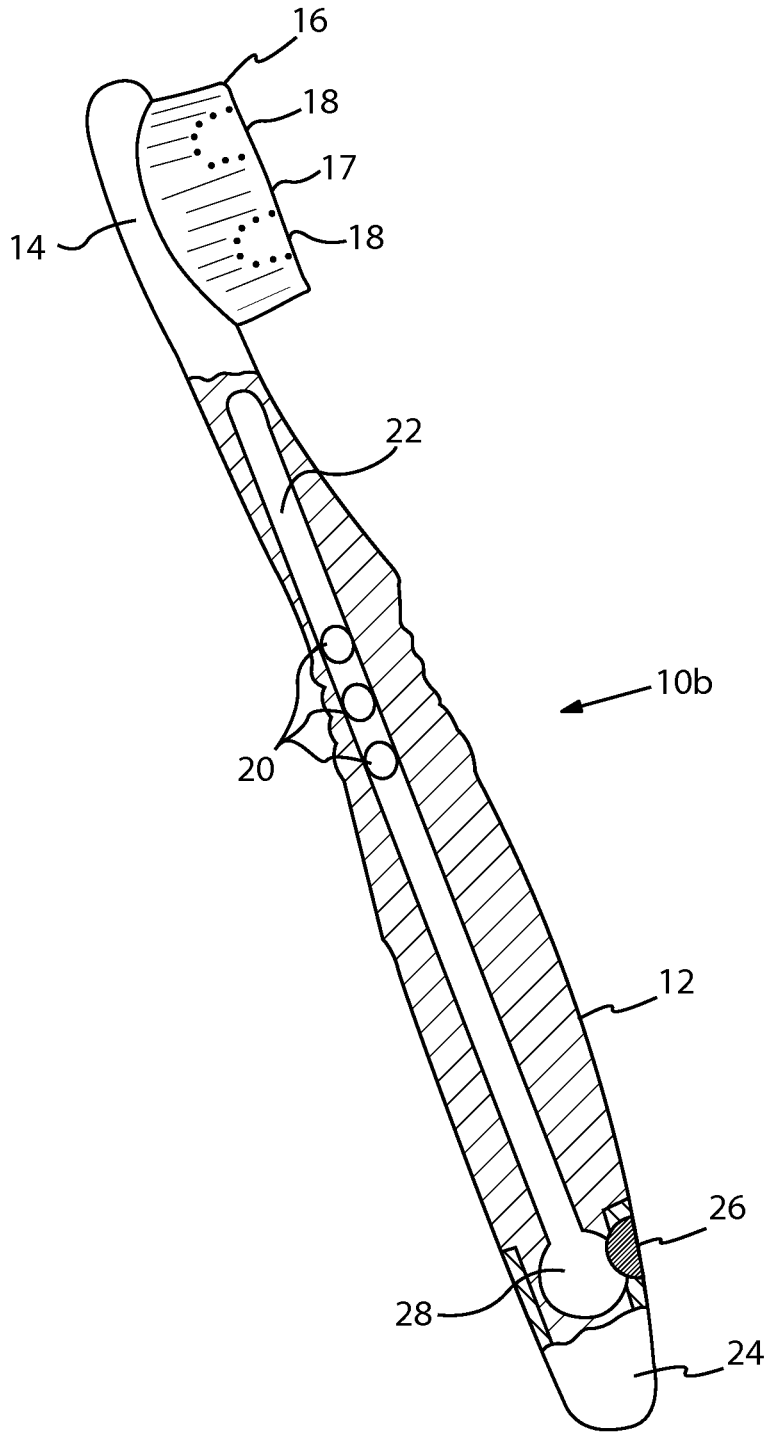
FIG. 5 is a side cross-sectional view of an embodiment of a toothbrush according to the invention.

Referring to FIG. 5, which is a side cross-sectional view of a different embodiment of a toothbrush 10*b* which is illustrated wherein bristles 17 are supported by a support member 14 which is connected with handle 12 which includes a chamber 22 having pellets 20 of a therapeutic remineralizing composition which can be either one part or two parts, i.e., the pellets can all be the same or can be different, and consist of at least one calcium salt, at least one water soluble phosphate salt, either a stabilizer or a hydrophilic, non-aqueous, water soluble vehicle, and optionally at least one water soluble fluorine salt. When one desires to apply the therapeutic composition, pellets 20 are withdrawn through entry port 28 after moving entry port cover 26 to an open position and then placed in bristle pockets 18 in bristles 17 in brush portion 16. Entry port 28 and entry port cover 26 are located close to bottom 24 in this embodiment. The pellets are in solid dehydrated form in a spherical shape, although any of a variety of shapes can be used and any of a variety of means of placing pellets in bristle pockets 18 can be used.

Figure 6:
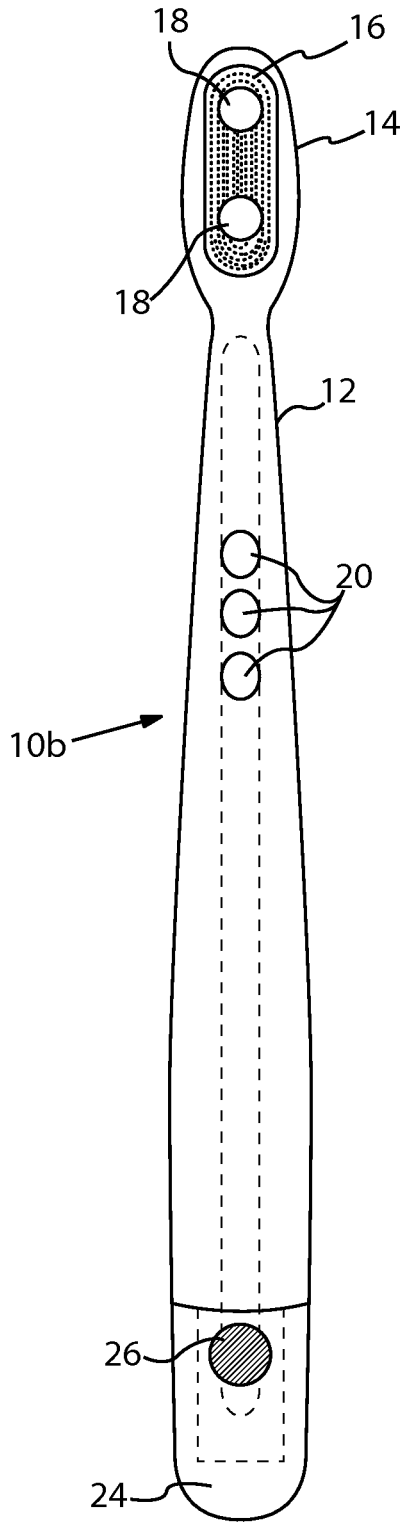
FIG. 6 is a front cross-sectional view of the toothbrush of FIG. 5.

FIG. 6 is a front cross-sectional view of the toothbrush 10 of FIG. 5 showing pockets 18 in brush portion 16 more clearly.

Figure 7:
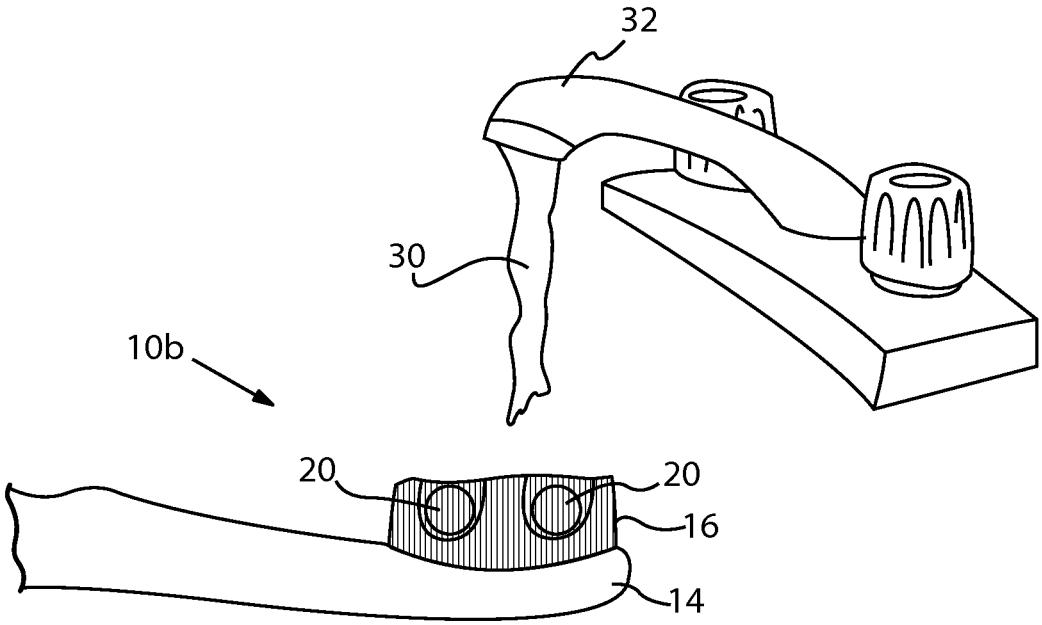
FIG. 7 is a side cross-sectional view of the top portion of the toothbrush of FIG. 5 being wet by water from a faucet.

FIG. 7 is a side cross-sectional view of the top portion of toothbrush 10*b* showing a spigot 32 with water 30 being applied to the brush portion 16, although it is not necessary to use water from a spigot since saliva in some embodiments is sufficient to activate the remineralizing composition.

Figure 8:
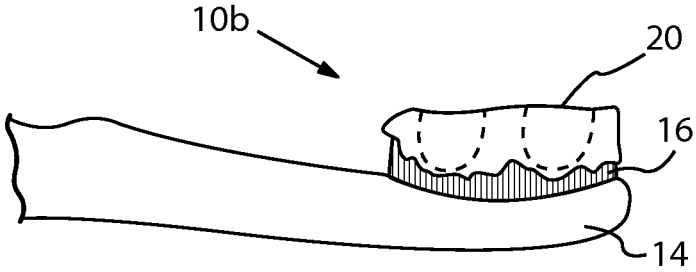
FIG. 8 is a side view, partially in cross-section of the toothbrush of FIG. 5 showing the composition having been activated by contact with water.

FIG. 8 is a side view, partially in cross-section, wherein the remineralizing composition is no longer in pellet form but is now in a paste or gel form. Pellets 20 are shown in phantom because they have reacted with the water or saliva in this view.

Figure 9:
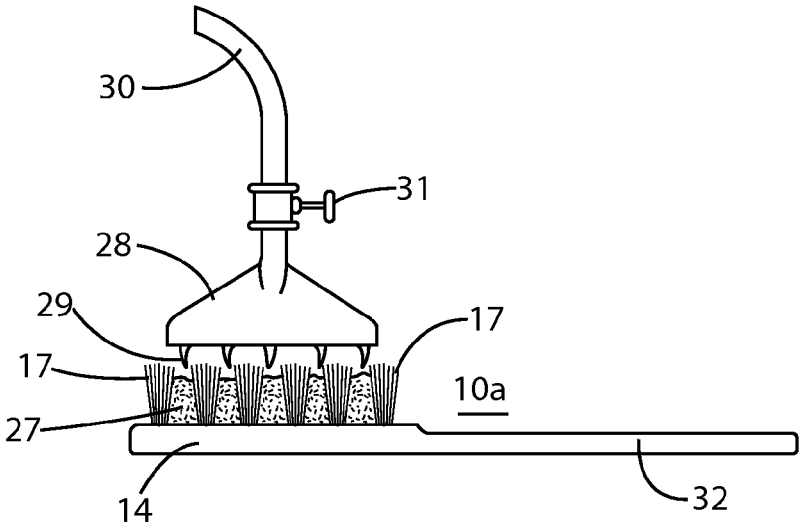
FIG. 9 is a side elevational view of an embodiment of a toothbrush being made using an automatic dispenser of composition.

FIG. 9 is a side elevational view of a different embodiment of at toothbrush 10*a* having bristles 17 having one part remineralizing composition 27 having been inserted by automatic dispenser 28 having nozzles 29 adapted to insert paste or gel 27 between bristles 17. Bristle support 14 is integral with handle 32. The dispenser 28 has valve 31 and inlet line 30.

Figure 10:
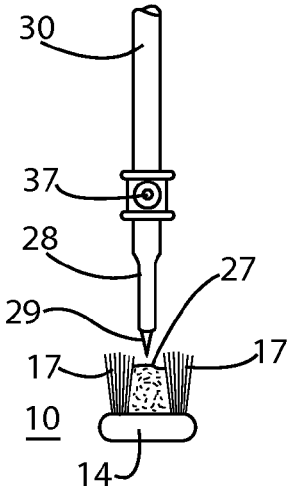
FIG. 10 is a front elevational view from the top of the toothbrush 10*a* and the dispenser.

FIG. 10 is a front elevational view from the top of the toothbrush 10*a* and side of dispenser 28 of FIG. 5, wherein the remineralizing composition 27 is illustrated between two sets of bristles, one on the left and one on the right side of support 14.

It will be recognized by those skilled in this art that the brush may take the form of an abrasive pad or any other brush equivalent which is capable of holding the tooth treatment composition, and further that the treatment composition may be in any of a wide variety of formats and types, as long as it is storage stable and activated only when in contact with water or saliva and, in the case of two component compositions, activated only when the two components are mixed together by physical contact with teeth or gums.

The present invention, therefore, is well adapted to carry out the objects and attain the ends and advantages mentioned, as well as others inherent therein. While the invention has been depicted and described and is defined by reference to particular preferred embodiments of the invention, such references do not imply a limitation on the invention, and no such limitation is to be inferred. The invention is capable of considerable modification, alteration and equivalents in form and function, as will occur to those ordinarily skilled in the pertinent arts. The depicted and described preferred embodiments of the invention are exemplary only and are not exhaustive of the scope of the invention. Consequently, the invention is intended to be limited only by the spirit and scope of the appended claims, giving full cognizance to equivalents in all respects.

What is claimed is:

1. A toothbrush having brush means and means to support the brush means; and a one or two part therapeutic tooth treatment composition which becomes activated when wet incorporated on the brush means or within the means to support the brush means in a manner such that the composition remains inactive during storage and is only activated when contacted with water or saliva, wherein the composition is a remineralization composition comprising at least one water-soluble calcium compound and at least one water-soluble phosphate compound and optionally a water-soluble fluorine compound in a hydrophilic, non-aqueous vehicle.

2. A toothbrush having brush means and means to support the brush means; and a therapeutic tooth treatment composition which becomes activated when wet incorporated on the brush means or within the means to support the brush means in a manner such that the composition remains inactive during storage and is only activated when contacted with water or saliva wherein the tooth treatment composition is a two part composition and each of the two parts is incorporated in different portions of the brush means, the different portions being separated by portions having no composition incorporate therein so that the two parts do not come in contact with each other until the toothbrush is wet with water or saliva and brushing occurs.

3. A toothbrush having brush means and means to support the brush means; and a two part therapeutic tooth treatment composition which becomes activated when wet incorporated on the brush means or within the means to support the brush means in a manner such that the composition remains inactive during storage and is only activated when contacted with water or saliva, the brush means including a first strip of a first composition on the brush means and a second strip of a second composition separated from the first strip so that the first and second compositions do not contact each other.

4. The toothbrush of claim 1, 2, or 3 wherein the brush means are selected from bristles, and abrasive pad.

5. The toothbrush of claim 1, 2, or 3 wherein the means to support the brush means is selected from a solid handle, a handle having a chamber within, a finger mount sheath, and a finger mount glove.

6. The apparatus of claim 1, 2, or 3 wherein the one or two part composition is selected from the group consisting of a remineralization composition, a whitening composition, and a fluoridating composition.

7. The apparatus of claim 1 or 2 wherein the composition is a stable one part composition comprising two or more salts in a hydrophilic, non-aqueous vehicle.

8. The apparatus of claim 1 wherein the hydrophilic, non-aqueous vehicle comprises glycerin.

9. The apparatus of claim 1 or 2 prepared by dipping the brush means in a one part tooth treatment composition and drying the composition.

10. The apparatus of claim 1, 2, or 3 wherein the composition is in the form of dry powder incorporated on or within the brush means so that the toothbrush is storage stable.

11. A method of producing a toothbrush according to claim 1, 2, or 3 comprising providing the toothbrush having the brush means and the means to support the brush means, incorporating on the brush means or within the means to support the brush means the one or two part composition in a manner such that the composition remains inactive during storage and is only activated when contacted with water or saliva.

12. The method of claim 11 wherein the composition is incorporated in the means to support the brush means in a manner such that the composition is released from the means to support the brush means onto the brush means upon mechanical force being applied to the means to support the brush means.

13. The method of claim 11 wherein the composition comprises a first part incorporated in a first chamber in the means to support the brush means and a second part incorporated in a second chamber in the means to support the brush means in a manner such that the first part and the second part are released from the means to support the brush means onto the brush means upon mechanical force being applied to the means to support the brush means and upon contact with each other, the two parts react in the presence of water or saliva.

14. A method of therapeutically treating a tooth comprising brushing the tooth with an article according to claim 1, 2, or 3.

* * * * *